United States Patent [19]

Franz

[11] Patent Number: 4,660,476

[45] Date of Patent: Apr. 28, 1987

[54] SELF-STEERING RAIL TRUCK

[76] Inventor: Philip M. Franz, P.O. Box 47340, Parklands, Johannesburg, Transvaal Province, South Africa

[21] Appl. No.: 714,877

[22] Filed: Mar. 22, 1985

[30] Foreign Application Priority Data

| | | | |
|---|---|---|---|
| Mar. 29, 1984 | [ZA] | South Africa | 84/2361 |
| Aug. 2, 1984 | [ZA] | South Africa | 84/5998 |
| Oct. 31, 1984 | [ZA] | South Africa | 84/8508 |

[51] Int. Cl.[4] ..... B61F 5/38; B61F 5/26

[52] U.S. Cl. ..... 105/168; 105/182.1; 105/224.1

[58] Field of Search ..... 105/157 R, 165, 167, 105/168, 182 R, 218 R, 218 A, 221, 224.1, 206 R, 157.1, 182.1, 218.1, 218.2, 206.1; 267/3

[56] References Cited

U.S. PATENT DOCUMENTS

| | | | |
|---|---|---|---|
| 274,806 | 3/1883 | Meatyard . | |
| 293,265 | 2/1884 | Meatyard . | |
| 301,510 | 7/1884 | Meatyard . | |
| 452,919 | 5/1891 | Hunt . | |
| 760,084 | 5/1904 | Stelle | 105/168 |
| 2,834,303 | 5/1958 | Furrer | 105/168 |
| 3,593,670 | 7/1971 | Aubert | 105/218 R |
| 3,920,231 | 11/1975 | Harrison et al. | 267/3 |
| 3,952,670 | 4/1976 | Harrison | 105/224.1 |
| 4,067,261 | 1/1978 | Scheffel . | |
| 4,067,262 | 1/1978 | Scheffel . | |
| 4,134,343 | 1/1979 | Jackson | 267/3 |
| 4,170,179 | 10/1979 | Vogel . | |

FOREIGN PATENT DOCUMENTS

| | | | |
|---|---|---|---|
| 837711 | 8/1951 | Fed. Rep. of Germany | 105/165 |
| 865148 | 5/1952 | Fed. Rep. of Germany | 105/165 |
| 1004589 | 3/1957 | Fed. Rep. of Germany | 105/157 R |
| 1010094 | 6/1957 | Fed. Rep. of Germany | 267/3 |
| 727978 | 10/1973 | South Africa . | |
| 751720 | 4/1976 | South Africa . | |
| 766091 | 10/1976 | South Africa . | |
| 757115 | 12/1976 | South Africa . | |
| 792750 | 6/1979 | South Africa . | |
| 802739 | 5/1980 | South Africa . | |
| 826357 | 8/1982 | South Africa . | |
| 827464 | 10/1982 | South Africa . | |
| 84/4905 | 6/1984 | South Africa . | |
| 18678 | of 1912 | United Kingdom | 105/165 |

OTHER PUBLICATIONS

"The Hunting Stability and Curving Ability of Railway Vehicles", H. Scheffel undated memorandum.

*Primary Examiner*—Randolph A. Reese

*Attorney, Agent, or Firm*—Browdy and Neimark

[57] ABSTRACT

A rail truck (28) includes a load-bearing element; a pair of longitudinally spaced live axle wheel sets (32) arranged to run longitudinally along a rail track (34), each wheel set including a transverse axle (36) having two transversely spaced axle boxes (38) and wheels (40) inboard of the axle boxes (38), the wheels having tapered treads (40.1) for generating steering forces on rail track curves; resilient suspension cushions (42) acting between the axle boxes (38) and the load-bearing element (30) for resiliently supporting the load-bearing element (30); and a side link lever system (44) on each side of the truck (28) interconnecting the two axle boxes (38) of the two wheel sets (32) on that side, and including a side lever (46) having pivotal support on the load-bearing element (30) at a region intermediate the axle boxes (38) on that side, and links (50,52) interconnecting opposite ends of the side lever (46) with the axle boxes on that side.

The rail truck further includes a transverse link lever system (54) which interconnects the side levers (46) on the opposite sides of the truck (28), or which interconnects the axle boxes (38) of at least one of the wheel sets (32), in such a way that in use as a result of the steering forces a yawing movement in one wheel set axle (36) is transferred into an opposing yawing movement of the other wheel set axle (36).

7 Claims, 23 Drawing Figures

SELF-STEERING RAIL TRUCK

This invention relates to a rail truck. It also relates to a power-driven rail truck, and in particular to suspension structures for rail trucks.

Wheel sets having steering characteristics by having tapered wheel treads and a resilient suspension, can be unstable while running on rail tracks, because of yawing. Instability can also arise from longitudinal movements of the load-bearing means relative to the wheel sets as a result of braking and acceleration forces.

One means of improving the tracking ability of a rail truck is to interconnect the axle boxes of two axially spaced wheel sets of a truck diagonally by struts crossing over at a region between the rotational axes of the wheel sets. The presence of such diagonal struts, in occupying the central space between the wheel sets, causes problems in the mounting of electric drive motors or brake gear, between the wheel sets of the truck.

It is an object of this invention to provide a resilient suspension for a rail truck having good steering ability, and also to provide a truck with room between its wheel sets to accommodate brake gear or electric drive motors.

SUMMARY OF INVENTION

Accordingly, the invention provides, according to one aspect, a rail truck which includes a load-bearing means;

a pair of longitudinally spaced live axle wheel sets arranged to run longitudinally along a rail track, each wheel set including a transverse axle having two transversely spaced axle boxes and wheels which have tapered treads for generating steering forces on rail track curves;

resilient suspension means acting between the axle boxes and the load-bearing means for resiliently supporting the load-bearing means;

a side link lever system on each side of the truck interconnecting the two axle boxes of the two wheel sets on that side, and including a side lever having pivotal support on the load-bearing means at a region intermediate the axle boxes on that side, and links interconnecting opposite ends of the side lever with the axle boxes on that side in such a way that in use as a result of the steering forces a yawing movement in one wheel set axle is transferred into an opposing yawing movement of the other wheel set axle; and a transverse link lever system interconnecting the side levers on the opposite sides of the truck or interconnecting the axle boxes of at least one of the wheel sets in such a way that, in use, the average wheel base between the wheel sets remains substantially constant.

The links of the side levers may be so connected to the axle boxes that in use yaw displacement of a wheel set axis when a wheel set enters a curve of the track, will result in the axis being substantially radial to that curve and will cause the other wheel set axis via the side link lever systems and the transverse link lever system to take up a position relative to the curve, which is also substantially radial. The pivotal axes of the side levers may be directed upwardly, and the side levers may be disposed transversely. The transverse link lever system may include an intermediate effort arm fast with each side lever, and a transverse link pivotally interconnecting the intermediate effort arms of the side levers.

The pivotal axes of the side levers may have limited freedom of movement relative to the load-bearing means. Such freedom of movement may be provided by transversely spaced pivots on a transverse lever pivotally mounted on the load-bearing means about an upwardly directed axis midway between the transversely spaced pivots of the side levers and positioned midway between the wheel sets and midway between the wheels. Alternatively, such freedom of movement may be provided by transversely spaced links pivotally mounted on the load-bearing means about upwardly directed axes.

The pivotal axes of the side levers may be provided midway between the axle boxes on their respective sides. It may be the inner ends of the side levers which are connected via the links to the axle boxes of one wheel set, and it may be the remote outer ends of the side levers which are connected via the links to the axle boxes of the other wheel set.

According to another aspect of the invention, a rail truck includes a load-bearing means;

a pair of longitudinally spaced wheel sets arranged to run longitudinally on a rail track, each wheel set including a transverse axle having two transversely spaced axle boxes and wheels which have tapered treads for generating steering forces on rail track curves;

resilient suspension means acting between the axle boxes and the load-bearing means for resiliently supporting the load-bearing means, and which includes for each axle box a load bearing means load member and an axle box support member co-operating wedge fashion via a pair of resilient cushions seating against load member pressure faces and support member pressure faces inclined relative to the direction of the load, the intersection of load pressure center lines through the cushions being at an elevation different from that of the rotational axis of the wheel set, the resilient cushsions permitting in use, resilient limited freedom of movement between axle boxes and load-bearing means in a direction transverse to the rotational axis of the axle, and having the effect that as a result of the steering forces a yawing movement in one wheel set axle when a wheel set enters a curve of the track will result in the said axle tending to become substantially radial to the curve.

The said pressure faces may lie in two pairs of intersecting parallel planes. The two pairs of intersecting parallel planes may converge upwardly, and the center lines of load pressure normal to the pressure faces may intersect at a level lower than the rotational axis of the wheel set. Alternatively, the two pairs of intersecting parallel planes may converge downwardly, and the center lines of load pressure normal to the pressure faces may intersect at a level higher than the rotational axis of the wheel set.

The rail truck may further include a side link lever system interconnecting the four axle boxes of the two wheel sets and including on each side a side lever having pivotal support on the load-bearing means at a region intermediate the axle boxes on that side, and links interconnecting opposite ends of the axle boxes on that side; and a pair of diagonal bars connected to the upper ends of posts extending upwardly from the axle boxes, each diagonal bar interconnecting diagonally opposed axle boxes of the two wheel sets.

The invention extends also to a rail wagon pair which includes a truck pivotally supporting the adjacent ends of the rail wagon pair in articulated fashion about longitudinally spaced upwardly directed axes which intersect the wheel set axles or which lie within the wheel base of the truck.

In operation, as a result of truck or wheel irregularities and braking and acceleration forces, the wheel sets may have a tendency to hunt or oscillate in yaw. In order to damp such hunting or oscillation, damping means are used. Such damping means may include snubbers interconnecting the side or transverse link lever systems on the one hand, and the axles, axle boxes, or the load-bearing means on the other hand.

BRIEF DESCRIPTION OF THE DRAWINGS

The various aspects of the invention will now be described by way of example with reference to the various embodiments as shown in the accompanying diagrammatic drawings.

In the drawings.

DETAILED DESCRIPTION

Figure 1:
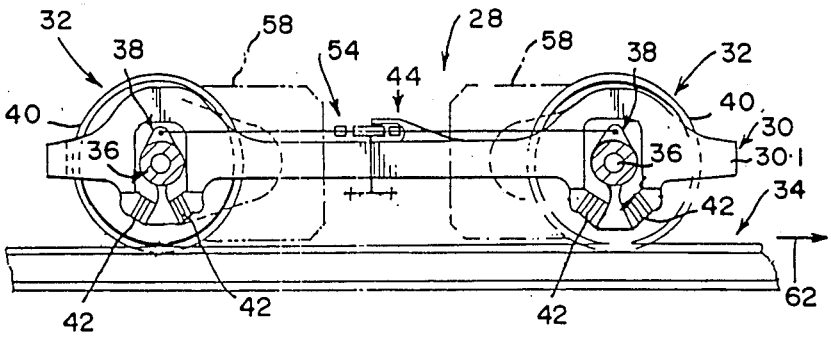
FIG. 1 shows a side elevation of one embodiment of a rail truck in accordance with the invention.

Referring to the drawings, reference numeral 28 refers generally to a rail truck which includes a load-bearing means 30 in the form of a rigid frame 30.1; and a pair of longitudinally spaced live axle wheel sets 32 arranged to run longitudinally along a rail track 34, each wheel set including a transverse axle 36 having two transversely spaced axle boxes 38 and wheels 40 inboard of the axle boxes 38, the wheels having tapered treads 40.1 for generating steering forces on rail track curves. The truck also includes resilient suspension means in the form of cushions 42 acting between the axle boxes 38 and the load-bearing means 30 for resiliently supporting the load-bearing means 30, and a side link lever system 44 on each side of the truck 28 interconnecting the two axle boxes 38 of the two wheel sets 32 on that side. The said side link lever system 44 on each side includes a side lever 46 having pivotal support 46.1 on the load-bearing means 30 at a region intermediate the axle boxes 38 on that side, and links 50 and 52 interconnecting opposite ends of the side lever 46 with the axle boxes 38 on that side.

Figure 2:
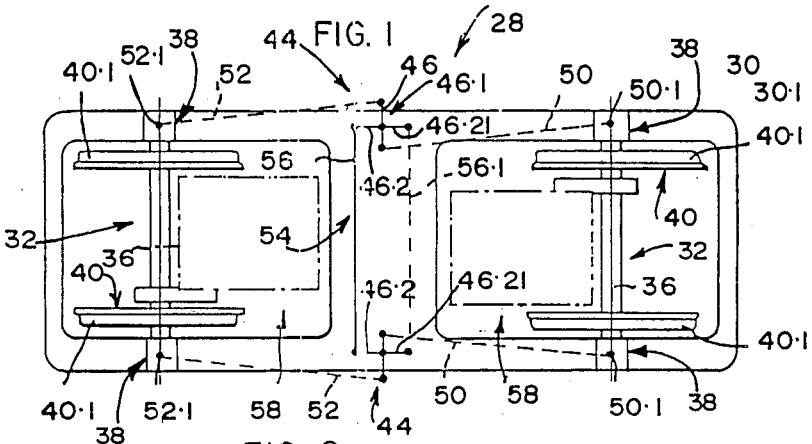
FIG. 2 shows a plan view corresponding to FIG. 1, and showing the layout of the side and transverse link lever systems.

The rail truck further includes a transverse link lever system 54 interconnecting the side levers 46 on the opposite sides of the truck in such a way that in use as a result of the steering forces a yawing movement in one wheel set axle 32 is transferred into an opposing yawing movement of the other wheel set axle 32. The links 50 and 52 are shown acting in line with the centres 50.1 and 52.1 of the axle boxes 38 (see FIG. 2).

The pivotal axes 46.1 of the side levers 46 are directed upwardly. The side levers 46 are disposed transversely to the direction of travel of the rail truck along the rails 34. Such an arrangement of side and transverse link lever systems 44 and 54 leave spaces 58 vacant which can be used for accommodating electric motors or brake gear.

Figure 3:
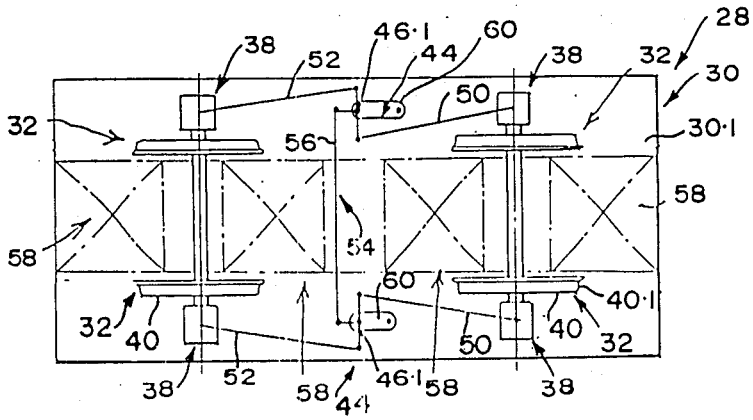
FIG. 3 shows a plan view of an alternative layout of the side and transverse link lever systems.

The transverse link lever system 54, in one arrangement, includes an intermediate effort arm 46.2 fast with each side lever 46, and a transverse link 56 pivotally interconnecting the intermediate effort arms 46.2 of the side levers 46. If desired, additional effort arms 46.21 may be provided, interconnected by an additional link 56.1. Referring to FIG. 3 of the drawings, the pivotal axes 46.1 of the side levers 46 are floating, ie the pivotal connections 46.1 have limited freedom of movement relative to the load-bearing means 30. Such floating pivotal axes 46.1 are provided by transversely spaced links 60 pivotally mounted on the load-bearing means 30 about upwardly directed axes. The pivotal axes 46.1 of the side levers are provided midway between the axle boxes on their respective sides, and it is the inner ends of the side levers 46 which are connected via the links 50 to the axle boxes 38 of one wheel set 32, and it is the remote outer ends of the side levers 46 which are connected via the links 52 to the axle boxes 38 of the other wheel set.

Figure 4:
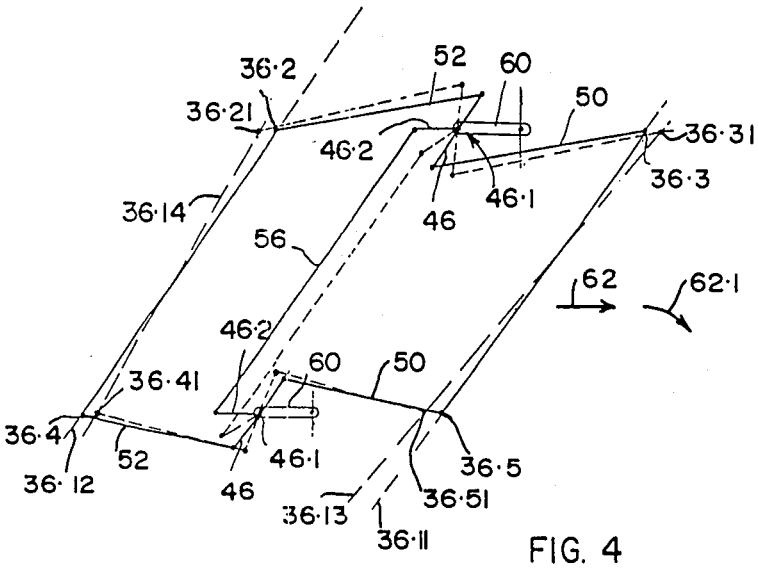
FIG. 4 shows a three-dimensional view in line diagram form of the side and transverse link lever systems of the rail truck of FIG. 3.

Referring now to FIG. 4 of the drawings, there is shown diagrammatically in three-dimensional form, the side and transverse link lever arrangement of the rail truck of FIG. 3. For clarity, the wheel sets 32 and the load-bearing means 30 have been omitted. The solid lines in FIG. 4 indicate the orientation of the link lever system when the rail truck is travelling straight along the rail track 34 in the direction of arrow 62. Assuming that the truck enters a curve, as indicated by arrow 62.1, then the leading wheel set will be displaced axially relative to the load-bearing means 32. Such displacement will be caused by the displacement of the inner wheel on the curve running on a smaller diameter of its tapered tread, and the outer wheel on the curve running on a larger diameter of its tapered tread. Thus, the rotational axis of the leading wheel set will be displaced from position 36.11 (straight travel) to a position 36.13 when travelling around the curve 62.1. This displacement has the result that the point 36.3 moves away slightly from the pivotal axis 46.1 to the position 36.31. The displacement also results in the point 36.2 moving slightly back to the position 36.21 by virtue of the operation of the lever 46 and links 50 and 52. These movements are transmitted via the intermediate effort arms 46.2 and the link 56 to cause the points 36.4 and 36.5 to move to the positions 36.41 and 36.51 respectively. The axes of the wheel sets will therefore move from the positions 36.11 and 36.12 when they were parallel to each other and travelling in a straight direction, as indicated by arrow 62, to the positions 36.13 and 36.14 in which the axes are urged towards substantially radial positions relative to the curve, as indicated by arrow 62.1. The axes in their positions 36.13 and 36.14 intersect substantially at the center of curvature of the curve indicated by arrow 62.1. Once the trailing wheel set is also running on the curve indicated by arrow 62.1, its wheels will also be subjected to the same forces as the leading wheel set. These forces tend to maintain its rotational axis in a substantially radial position, as indicated at 36.14.

Figure 5:
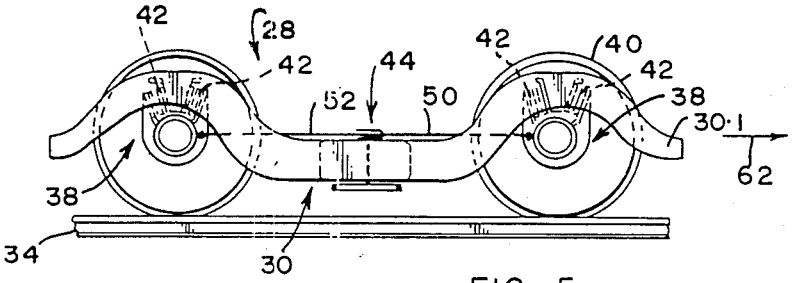
FIG. 5 shows a side elevation of another embodiment of rail truck, with an alternative suspension system.
Figure 6:
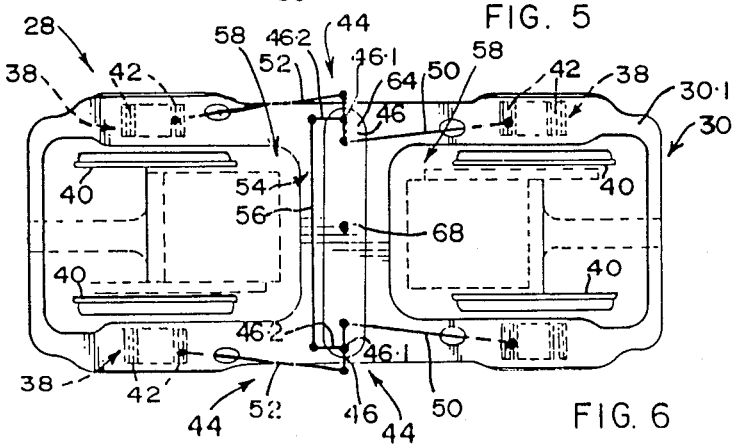
FIG. 6 shows a plan view corresponding to FIG. 5.

Referring to FIGS. 5 and 6 of the drawings, according to another arrangement, the pivotal axes 46.1 of the side levers 46 are floating, ie they have limited freedom of movement relative to the load-bearing means 30. Such freedom of movement in this arrangement is provided by transversely spaced pivots 46.1 on a transverse lever 64 pivotally mounted on the load-bearing means 30 about an upwardly directed axis 68 midway between the transversely spaced pivots 46.1 of the side levers 46 and positioned midway between the wheel sets 32 and midway between the wheels 40. Except for the transverse lever 64 and for the side levers 46 not having intermediate effort arms 46.2, this embodiment of the link lever systems 44 and 54 is similar to that of FIGS. 1, 2 and 3, and operates in similar fashion.

Figure 7:
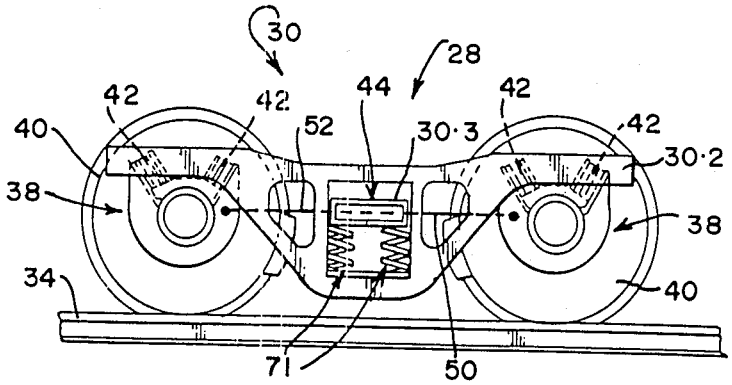
FIG. 7 shows a side elevation of yet a further embodiment of rail truck utilizing load-bearing means in the form of side frames and a bolster.
Figure 8:
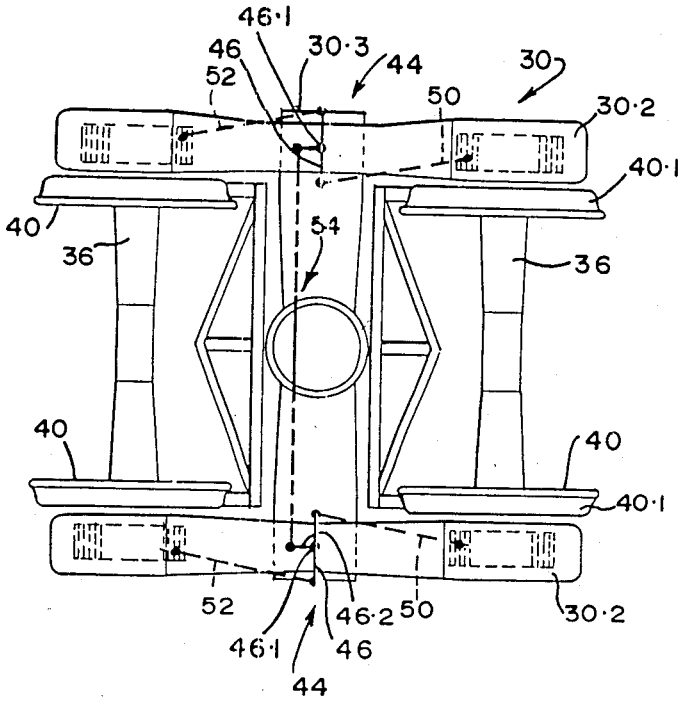
FIG. 8 shows a plan view corresponding to FIG. 7.

Referring now to FIGS. 7 and 8 of the drawings, there is shown another arrangement, in which the load-bearing means 30 is in the form of a pair of side frames 30.2 having a transverse bolster 30.3 supported via springs 71 in the side frames 30.2. The side frames 30.2 themselves are supported by the axle boxes 38 via the resilient cushions 42. The link lever systems 44 and 54 which interconnect the wheel sets 32 to transmit steering forces, are substantially the same as those already described. The side levers 46 of the side link lever systems 44 have their pivotal supports 46.1 on the bolster 30.3.

Figure 9:
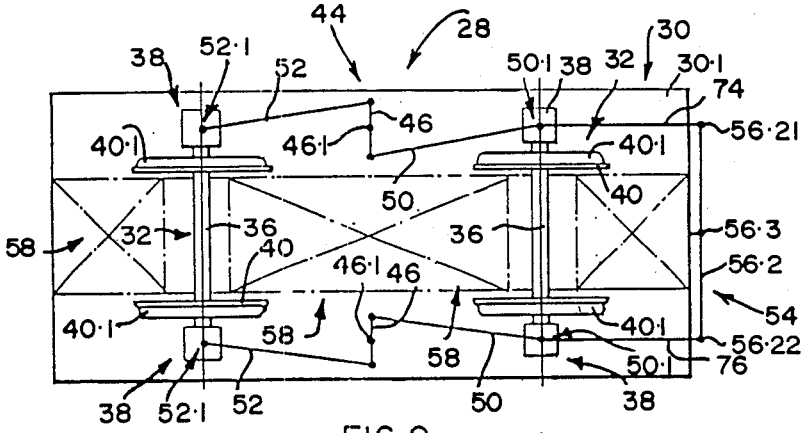
FIG. 9 shows a plan view of a rail truck with a further layout of side and transverse link lever systems.

Referring to FIG. 9, the transverse link lever system 54 interconnecting the side levers 46 includes a transverse lever 56.2 pivotally mounted about an upwardly directed axis 56.3, outside the wheel base of the truck, disposed midway in the track width of the wheels 40. The transverse lever 56.2 is pivotally connected at its ends 56.21 and 56.22 via links 74 and 76 to the axle boxes 38 of the nearest wheel set 32.

Figure 10:
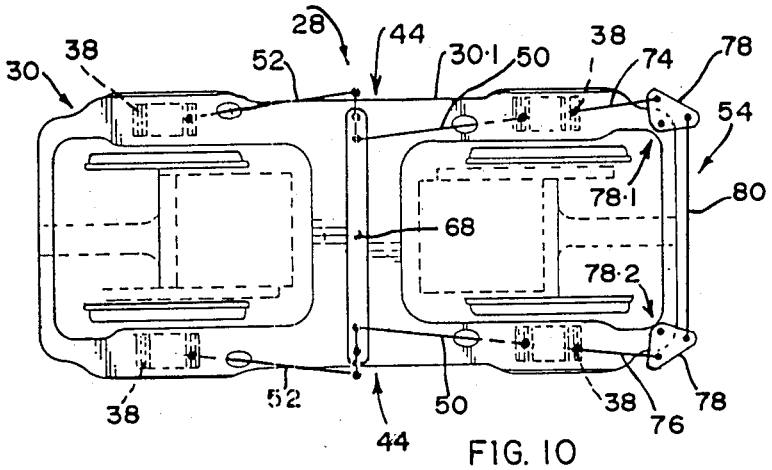
FIG. 10 shows a plan view of a rail truck with yet a further variation of side and transverse link lever systems.
Figure 11:
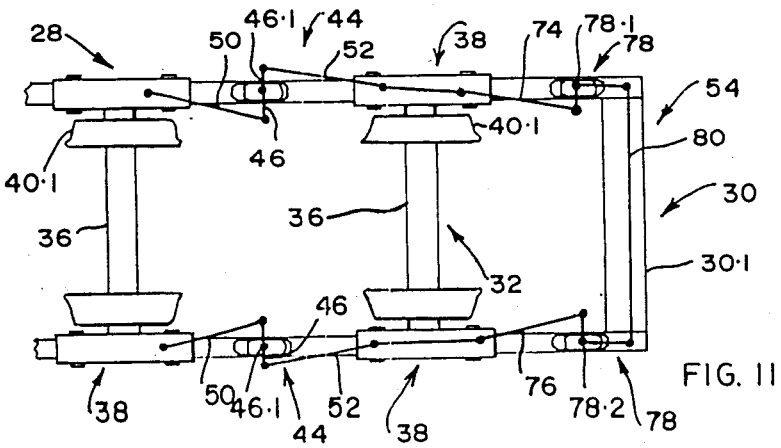
FIG. 11 shows a plan view of a rail truck with still a further variation of side and transverse link lever systems.

According to another arrangement referring to FIGS. 10 and 11, the transverse link lever system 54 includes two bell-crank levers 78 mounted on the load bearing means 30 about upwardly directed axes 78.1 and 78.2 on opposite sides of the truck outside the wheel base of the truck. The bell-crank levers 78 are connected on their respective sides by lines 74 and 76 to the axle boxes 38 of a wheel set 32 and are interconnected by a transvere link 80 outside the wheel base.

Figure 12:
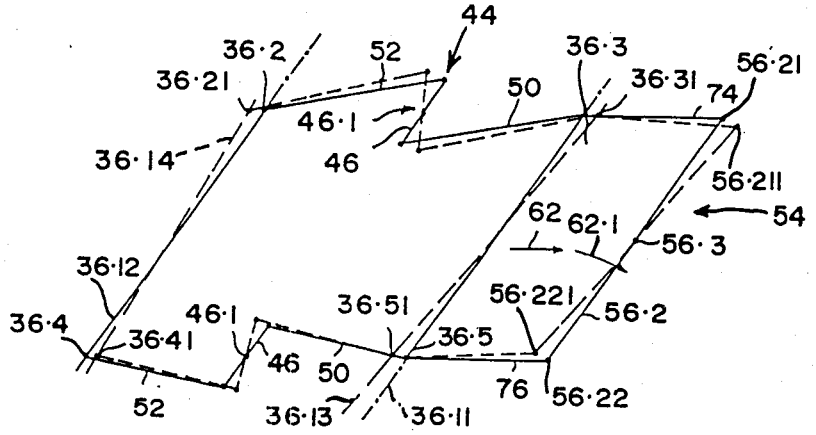
FIG. 12 shows a three-dimensional view in line diagram form of the operation of the side and transverse link lever systems of the rail truck of FIG. 9.

Referring to FIG. 12, there is shown diagrammatically in three-dimensional form, the side and transverse link lever arrangement of the rail truck shown in FIG. 9. For clairity, the wheel sets 32, the load-bearing means 30, and axle boxes 38 have been omitted. The functioning and operation of the lever linkage of FIG. 12 is similar to that of the lever linkage of FIG. 4 as described. However, instead of the transverse link lever arrangement 54 being provided between the wheel sets, a transverse lever 56.2 is provided outside the wheel base. The solid lines correspond to the positions of the links 74 and 76 and of the lever 56.2 when the truck is travelling straight in the direction of arrow 62. On a curve corresponding to that indicated by arrow 62.1, the pivotal connections 56.21 and 56.22 move to the positions 56.211 and 56.221 respectively, as shown on the drawing. These displaced positions 56.211 and 56.221 of the connections 56.21 and 56.22 correspond to the positions 36.31 and 36.51 of the connections 36.3 and 36.5.

Figure 13:
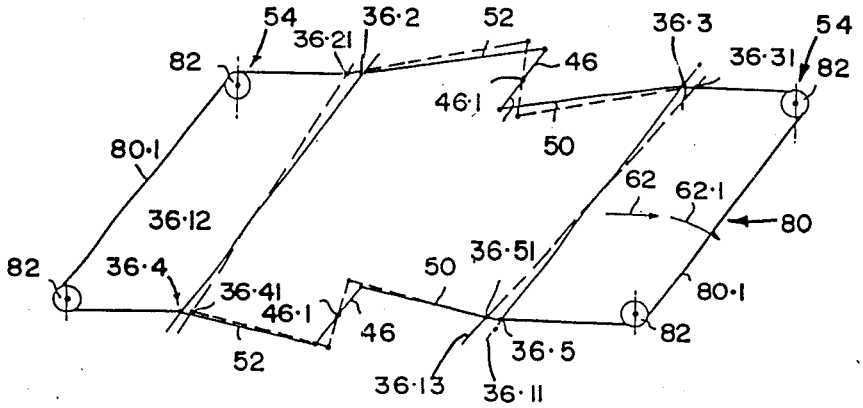
FIG. 13 shows diagrammatically a three-dimensional view of a further variation of side and transverse link lever systems of a rail truck.

In yet another arrangement (see FIG. 13), the transverse link lever system 54 interconnecting the transversely spaced axle boxes 38 of a wheel set 32, includes a transverse link 80 in the form of a flexible element 80.1 outside the wheel base passing over the deflecting pulleys 82 mounted on the load-bearing means 30. A flexible transverse link 80.1 must be provided at both ends of the truck. The function and operation of this arrangement are similar to that already described with reference to FIG. 4.

It is an advantage of the embodiments illustrated in FIGS. 9 to 13 of the drawings, that, when applied to bottom discharge hoppers, the hoppers will have good steering characteristics and will have good stability when negotiating curves, yet the link lever systems will not interfere with discharging from the bottom of the hoppers. For example, with reference to FIG. 9, reference numeral 58 generally indicates areas bounded by chain-dot lines which are available for discharge and which are not obstructed by the side and transverse link lever systems 44 and 54.

Figure 14:
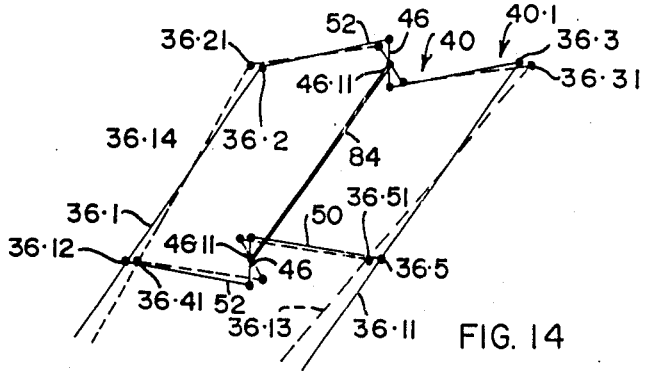
FIG. 14 shows diagrammatically yet a further variation of the side and transverse link lever systems of a rail truck.

A still further arrangement suitable for low-speed operation, is illustrated in FIG. 14. In this embodiment, the pivotal axes 46.11 of the side levers are co-axial, being provided by a pivotally mounted transverse bar 84 whose pivotal axis is co-axial with the pivotal axes 46.11 of the side levers 46, and substantially parallel to the rotational axes of the wheel sets. An inspection of the drawing shows that the functioning of the wheel sets 32 on curves will be similar to that described with reference to FIGS. 4, 12 and 13 of the drawings.

Figure 15:
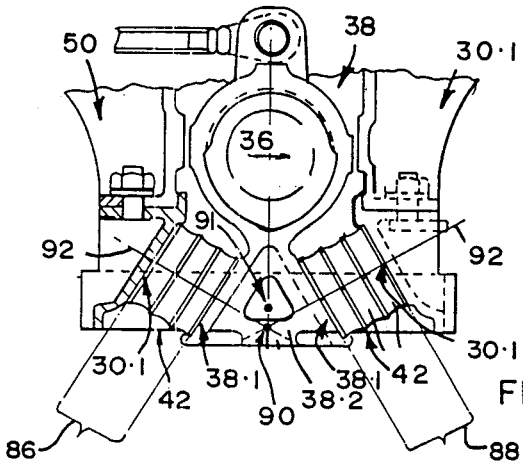
FIG. 15 shows a detailed part-sectional side elevation of the suspension of the rail truck of FIG. 1.
Figure 16:
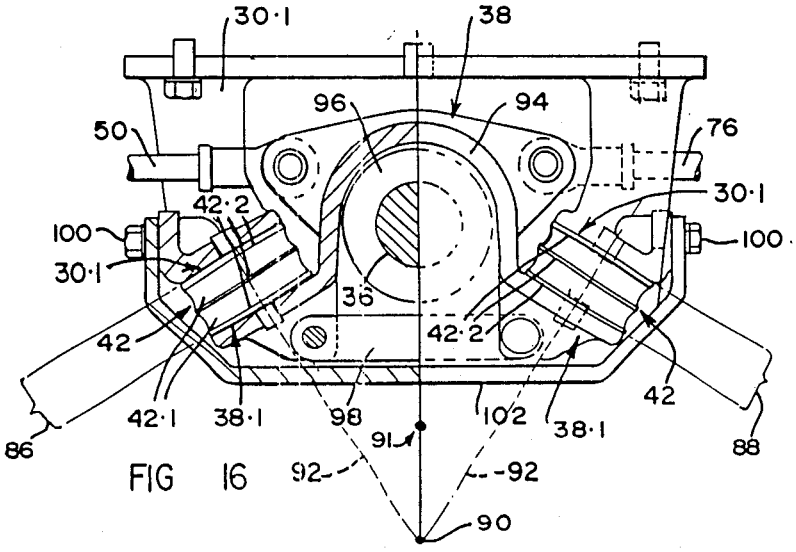
FIG. 16 shows a detailed part-sectional side elevation of an alternative suspension for a rail truck according to the invention.

Referring to FIGS. 15 and 16 of the drawings, the suspension means for each axle box 38 includes a pair of resilient cushions 42 at a level lower than the axle 36, and acting between two opposed sets of loading pressure faces 30.1 and supporting pressure faces 38.1 lying in two pairs of parallel planes 86 and 88 which converge upwardly. The intersection 90 of the centre lines 92 of load pressure normal to the pressure faces 30.1 and 38.1 lies at a level lower than the rotational axis of the axle 36. The support member pressure faces 38.1 are provided wedge fashion, at a level lower than the rotational axis of axle 36, by a hanger 38.2 suspended from the axle 36.

Referring in particular to FIG. 16, there is shown an axle box for a rail truck, which includes a saddle 94 adapted to seat on a bearing 96 on the end of the axle 36 of a wheel set, and in which the pressure faces 38.1 for the resilient cushions 42 in the lower set of intersecting planes are provided by the saddle 94. This axle box has a pivotally mounted longitudinal locking element 98 adapted in use to pass with clearance under the bearing 96 to guard against unwanted displacement of the saddle 94 from the bearing 96. A wheel set 32 may easily be removed from the load-bearing means 30 by loosening the set screws 100, and dropping the safety strap 102, and releasing the locking element 98.

The resilient cushions 42 for each axle box 38 are disposed symmetrically fore and aft of the rotational axis of a wheel set 32. The cushions may be of circular or rectangular section. Each resilient cushion 42 comprises a plurality of layers of elastomeric material 42.1 sandwiched between reinforcing layers 42.2 of non-elastic material, such as mild steel plate. The layers of elastomeric material 42.1 are arranged substantially parallel to the pressure faces 30.1 and 38.1, and are bonded to the layers of non-elastic material.

Figure 17:
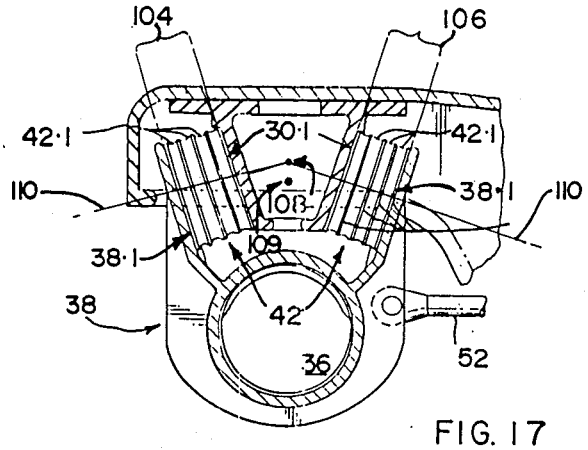
FIG. 17 shows a part-sectional side elevation of yet a further variation in the suspension of a rail truck in accordance with the invention.

Referring now to FIG. 17, there is shown another type of suspension means for each axle box 38 which includes a pair of resilient cushions 42 at a level higher than the axle 36 and acting between opposed sets of loading pressure faces 30.1 and supporting pressure faces 38.1 lying in two pairs of parallel planes 104 and 106 which converge downwardly. The intersection 108 of the centre lines 110 of pressure normal to the pressure faces 30.1 and 38.1 lie at a level higher than the rotational axis of the axle 36. The loading pressure faces 30.1 are provided by a load-bearing means load member 30.2 which is of wedge shape.

Figure 18:
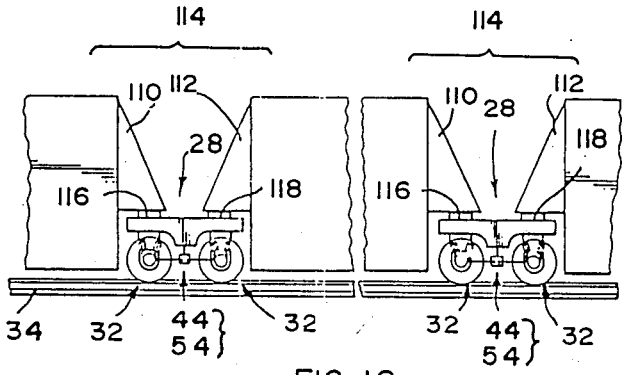
FIG. 18 shows a side elevation of rail wagons in combination with rail trucks in accordance with the invention.
Figure 19:
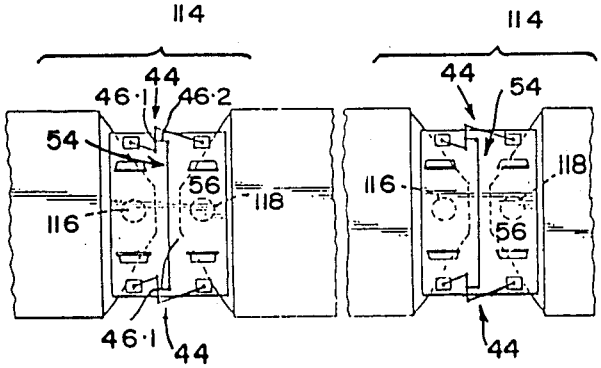
FIG. 19 shows a plan view of the rail wagons of FIG. 18.

Referring to FIGS. 18 and 19, there is shown in combination, a rail truck as described, with a rail wagon pair, the truck 28 pivotally supporting the adjacent ends 110 and 112 of the rail wagon pair 114 in articulated fashion via center plates 116 and 118 about longitudinally spaced upwardly directed axes which intersect the wheel set axles 36 or which lie within the wheel base of the truck 28. The mounting of the wagons 114 at opposite ends on two different trucks 28 provides a large volumetric capacity of the wagons between trucks 28, and a large area for bottom discharge wagons.

Figure 20:
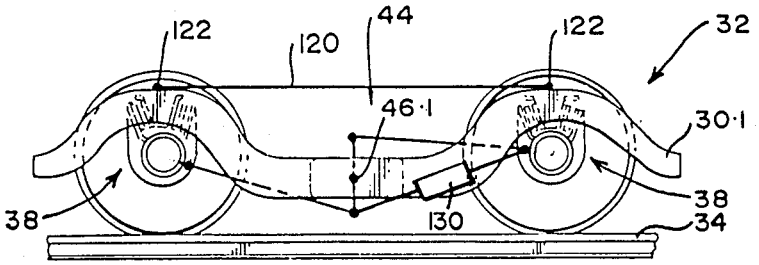
FIG. 20 shows a side elevation of yet another variation of side and transverse link lever system.
Figure 21:
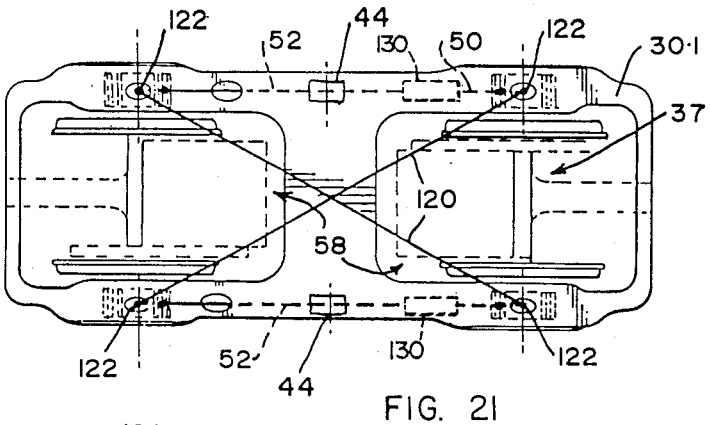
FIG. 21 shows a plan view corresponding to FIG. 20.
Figure 22:
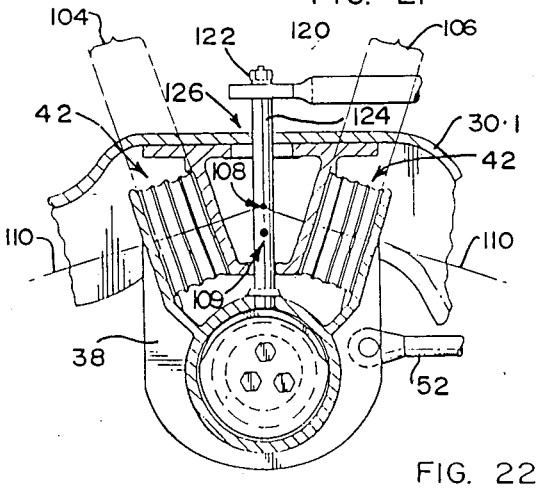
FIG. 22 shows a detailed part-sectional side elevation of the suspension and lever linkage systems of the rail truck of FIGS. 20 and 21.

Referring now to FIGS. 20 to 23, there is shown a rail truck having side link lever systems 44 with diagonal bars 120 instead of a transverse link lever system 54. The bars 120 are secured at connections 122 to posts 124 which project upwardly from the axle boxes 38. The pots 124 are disposed between the resilient cushions 42 of the suspension shown in FIG. 17. In order to accommodate the posts 124, openings 126 are provided in the frame 30.1, as shown in FIG. 22. The pivotal axes 46.1 of the side link lever systems 44 may be directed upwardly or horizontally, as desired. The elevated diagonal bars 120, made possible by the use of the posts 124, provide spaces 58 between the wheel sets and below the bars 120, to accommodate electric motors, brake gear, and the like.

Figure 23:
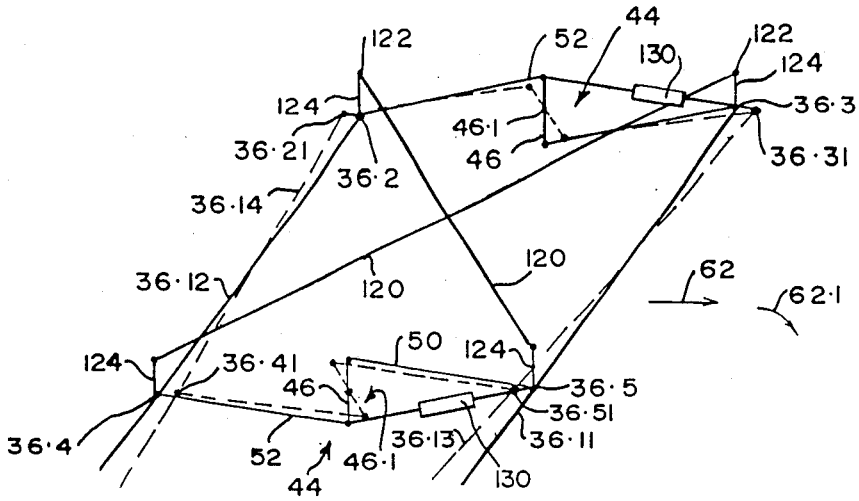
FIG. 23 shows a three-dimensional view in line diagram form of the operation of the steering lever linkage systems of the rail truck of FIGS. 20 and 21.

Referring now to FIG. 23 of the drawings, there is shown diagrammatically in three-dimensional form, the side lever link arrangements 44 and the diagonal bars 120 and their posts 124. For clarity, the wheel sets 32, the load-bearing means 30, and the axle boxes 38 have been omitted. The functioning and operation of the steering linkage, as shown in this diagram is similar to that as already described in FIGS. 4, 12, 13 and 14 of the drawings. In this arrangement however, the diagonal bars 120 with their posts 124, replace the transverse lever linkage system 54 as described with reference to the other drawings.

The suspensions shown in FIGS. 15, 16, 17, and 22 of the drawings have centers of rotation 91 and 109 which lie at levels different from the corresponding intersections 90 and 108 of load pressure lines normal to the pressure faces 30.1 and 38.1. The positions of the centers of rotation 91 and 109 relative to the intersections 90 and 108 depend upon the stiffness characteristics of the resilient cusions 42, and upon their longitudinal spacing.

For a suspension most responsive to steering forces and for least yaw restraint, the spacing between the centres of rotation 91 and 109 on the one hand, and the rotational axes of the axles 36 on the other hand, should be as large as possible.

Thus, for the suspensions shown in FIGS. 15 and 16, the centers of rotation 91 lie at levels higher than the intersections 90 and at levels lower than the rotational axes of the axles 36. Again, the suspensions shown in FIGS. 17 and 22 have centers of rotation 109 which lie at levels lower than the intersections 108 and at levels higher than the rotational axes of the axles 36.

Referring further to FIGS. 20, 21 and 23 of the drawings, snubbers 130 are shown interconnecting each of the side levers 46 and the axle boxes 38 on opposite sides of the truck. Snubbers can be connected in similar fashion to the other embodiments of rail trucks shown in the drawings. For transversely disposed side levers mounted to pivot about upwardly directed axes, the snubbers 130 will preferably be connected to their outer ends. This will facilitate regular inspection and maintenance of the snubbers.

I claim:

1. A self-steering rail truck comprising:

a load-bearing means having support means for supporting a rail vehicle body thereon;

a pair of longitudinally spaced live axle wheel sets arranged to run longitudinally along a rail track, each wheel set including a transverse axle having two transversely spaced axle boxes and wheels which have tapered treads for generating steering forces on rail track curves;

resilient suspension means acting between the axle boxes and the load-bearing means for resiliently supporting the load-bearing means;

a side link lever system on each side of the truck interconnecting the two axle boxes of the two wheel sets on that side, and including a transversely disposed side lever having an intermediate effort arm and having pivotal support on the load-bearing means about a pivotal axis directed upwardly at a region intermediate the axle boxes on that side, and links interconnecting opposite ends of the side lever with the axle boxes on that side in such a way that in use, as a result of the steering forces, a yawing movement in one wheel set axle is transferred into an opposite yawing movement of the other wheel set axle; and a transverse member within the wheel base of the wheel sets interconnecting the intermediate effort arms of the side levers on the opposite sides of the truck in such a way that, in use, as a result of the co-operation between the transverse member and the side link lever systems, the average wheel base between the wheel sets remains substantially constant, the transverse member and the said side link lever systems being free from contact with any rail vehicle body which may be mounted on the load bearing means.

2. A self-steering rail truck as claimed in claim 1, in which the pivotal axes of the side levers in use have limited freedom of movement relative to the load-bearing means by being mounted in laterally spaced relationship on a transverse lever which is pivotally mounted on the load-bearing means about an upwardly directed axis disposed midway within the track width of the wheels.

3. A rail vehicle which includes at least one rail truck as claimed in claim 1; and a vehicle body supported on the load-bearing means of the rail truck in such a way that the side link lever systems on the load-bearing means and the interconnection of the transverse member with the said side link lever systems are free of contact of the vehicle body.

4. A self steering rail truck which includes a load-bearing means having support means for supporting a rail vehicle body thereon;

a pair of longitudinally spaced live axle wheel sets arranged to run longitudinally along a rail track, each wheel set including a transverse axle having two transversely spaced axle boxes and wheels which have tapered treads for generating steering forces on rail track curves;

resilient suspension means acting between the axle boxes and the load bearing means for resiliently supporting the load-bearing means;

a side link lever system on each side of the truck interconnecting the two axle boxes of the two wheel sets on that side, and including a transversely disposed side lever having pivotal support on the load-bearing means about a pivotal axis directed upwardly at a region intermediate the axle boxes on that side, and links interconnecting opposite ends of the side lever with the axle boxes on that side in such a way that in use as a result of the steering forces a yawing movement in one wheel set axle is transferred to an opposite yawing movement of the other wheel set axle; and two bell-crank levers mounted on the load-bearing means about upwardly directed axes on opposite sides of the truck outside the wheel base of the truck, the bell-crank levers on their respective sides being connected by links to the axle boxes of a wheel set and being interconnected by a transverse link outside the wheel base, in such a way that, in use, as a result of the co-operation between bell-crank levers and the side link lever systems, the average wheel base between the wheel sets remains substantially constant, the interconnecting transverse link outside the wheel base being free from contact with any rail vehicle body which may be mounted on the load-bearing means.

5. A self-steering rail truck as claimed in claim 4, in which said pivotal support of the side levers on the load-bearing means is provided at laterally spaced positions on a transverse lever which is pivotally mounted on the load-bearing means about an upwardly directed axis, midway within the track width of the wheels.

6. A rail vehicle which includes at least one rail truck as claimed in claim 4; and a vehicle body supported on the load-bearing means of the rail truck in such a way that the side link lever systems on the load-bearing means and the interconnection of the said link lever systems via the said bell-crank levers and the interconnecting transverse link outside the wheel base are free of contact of the vehicle body.

7. A three-piece self-steering rail truck which comprises a pair of longitudinally spaced live axle wheel sets arranged to run longitudinally along a rail track, each wheel set including a transverse axle having two transversely spaced axle boxes and wheels which have tapered treads for generating steering forces on rail track;

a load-bearing means which includes a transverse bolster and a pair of transversely spaced side frames flexibly supporting the bolster at its ends in between the wheel sets;

resilient suspension means acting between the axle boxes and the ends of the side frames;

a side link lever system on each side of the truck interconnecting the two axle boxes of the two wheel sets on that side, and including a transversely disposed side lever having an intermediate effort arm and having pivotal support on the bolster about a pivotal axis directed upwardly at a region intermediate the axle boxes on that side, and links interconnecting opposite ends of the side lever with the axle boxes on that side in such a way that in use, as a result of the steering forces, a yawing movement in one wheel set axle is transferred into an opposite yawing movement of the other wheel set axle; and a transverse member within the wheel base of the wheel sets interconnecting the intermediate effort arms of the side levers on the opposite sides of the truck in such a way that, in use, as a result of the co-operation between the transverse member and the side link lever systems, the average wheel base between the wheel sets remains substantially constant.

* * * * *